US008630574B2

(12) United States Patent
Satomi

(10) Patent No.: US 8,630,574 B2
(45) Date of Patent: Jan. 14, 2014

(54) IMAGE FORMING SYSTEM

(75) Inventor: Yoshiyasu Satomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 13/217,700

(22) Filed: Aug. 25, 2011

(65) Prior Publication Data

US 2012/0051815 A1 Mar. 1, 2012

(30) Foreign Application Priority Data

Aug. 26, 2010 (JP) ..... 2010-189467

(51) Int. Cl.
*G03G 15/20* (2006.01)
*G03G 15/00* (2006.01)

(52) U.S. Cl.
USPC ..... 399/364; 399/341

(58) Field of Classification Search
USPC ..... 399/341, 364, 401
See application file for complete search history.

(56) References Cited

U.S. PATENT DOCUMENTS 7,933,544 B2 4/2011 Nishikata et al.
2007/0280760 A1 12/2007 Nishikata et al.
2009/0207429 A1 8/2009 Iguchi
2010/0034569 A1* 2/2010 Moteki ..... 399/341
2011/0170887 A1 7/2011 Nishikata et al.

FOREIGN PATENT DOCUMENTS

JP 2007-328023 A 12/2007
JP 2009-190336 A 8/2009

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming system includes a non-transparent image forming apparatus including a first image forming station for forming a non-transparent toner image and for transferring the non-transparent toner image onto a recording material, and a transparent image forming apparatus including a second image forming station for forming a transparent toner image and for transferring the transparent toner image onto the recording material discharged from a first image heating unit. Formation of images as a combination of the non-transparent image and the transparent image is capable on both sides of the recording material by controlling a first re-feeding unit and a second re-feeding unit. The image forming system further includes a first reversing unit for feeding the recording material discharged from the first image heating unit to the second image forming station with a reversed facing orientation, and a controller for controlling the first reversing unit in accordance with a combination of a non-transparent image formation process and a transparent image formation process for both sides of recording material.

8 Claims, 6 Drawing Sheets

IMAGE FORMING SYSTEM

FIELD OF THE INVENTION AND RELATED ART

The present invention relates to an image formation system capable of forming a color image on recording medium, and then, forming a solid transparent image across the entirety of the color image on the recording medium. More specifically, it relates to a method for controlling the image formation system in such a manner that whether a color image is formed on only one or both surfaces of a sheet of recording medium, and whether a transparent image is formed on only one or both surfaces of the sheet of recording medium, the resultant image be roughly in the same range in gloss.

There have been widely known various image forming apparatuses which fix a single monochromatic toner image or multiple monochromatic toner images, different in color, to recording medium by applying heat and pressure to the recording medium and the toner images thereon, with the use of a fixing device. Generally speaking, the areas of a sheet of recording medium, which are covered with fixed toner, are higher in gloss than the plain surface of recording medium. This difference in gloss between the areas of recording medium, which are covered with fixed toner and the plain surface of recording medium makes the white areas of a photographic image or the like formed by an image forming apparatus which uses toner appear lower in gloss. Because of this phenomenon, a photographic image or the like formed by an image forming apparatus which uses toner is sometimes evaluated lower in image quality.

Thus, there has been put to a practical use an image forming apparatus which covers the white areas of a fixed toner image on recording medium, with a transparent image, that is, an image formed of transparent toner, and then, fixes the transparent image to output an image which is uniform in gloss (Japanese Laid-open Patent Application 2009-190336).

Further, there has been proposed in Japanese Laid-open Patent Application 2007-328023 an image formation system, which is made up of a color image forming apparatus which forms a color image with the use of color toners, and a transparent image forming apparatus which forms a transparent image with the use of transparent toner and is in connection to the outlet side of the color image forming apparatus (FIG. 1). In the case of this image formation system, a monochromatic toner image, or monochromatic toner images different in color, are transferred onto recording medium in the image formation station, or image formation stations, of a color image forming apparatus, and are fixed by a fixing apparatus to the recording medium. Then, the recording medium having a fixed monochromatic toner image, or a fixed multi-color image, is conveyed into the image formation station of the transparent image forming apparatus, without being turned upside down. Then, a transparent toner image is transferred onto the recording medium in the image forming station of the transparent image forming apparatus. Then, the transparent toner image is fixed to the recording medium and the fixed multicolor toner image thereon by the fixing device of the transparent image forming apparatus. Then, the recording medium is discharged from the transparent image forming apparatus, or is discharged into a post-processing apparatus.

There has been proposed also in Japanese Laid-open Patent Application 2007-328023 to enable the image forming apparatus in this patent application to be selectively operated in one of multiple operational modes which are different in the combination of whether or not a color image is formed on only one or both surfaces of recording medium, and whether or not a transparent image is formed on only one or both surfaces of recording medium.

When the image forming apparatus disclosed in Japanese Laid-open Patent Application was operated in the mode in which a transparent image is not formed on either surface of the recording medium after the formation of a color image on one of the surfaces of the recording medium, the resultant images were substantially different in gloss from the images formed by forming a transparent image across the color image. To describe this phenomenon in detail with reference to FIG. 1, when the image forming apparatus in the abovementioned patent application was operated in the abovementioned mode, a color image is subjected to heat and pressure by a fixing apparatus 145 of a color image forming apparatus, and then, the surface of the fixed color image is subjected to heat and pressure by the fixing device 245 of the transparent image forming apparatus without the formation of a transparent image across the fixed color toner image. Therefore, the color image is increased in gloss.

Thus, it has been proposed to keep the fixing apparatus of a transparent image forming apparatus turned off when the color image forming apparatus is in the mode in which no transparent toner image is formed. This proposal, however, is not practical for the following reason: That is, if the fixing apparatus is kept turned off while the color image forming apparatus is operated in the mode in which no transparent is formed, it takes a certain length of time to start up the fixing device of the transparent image forming apparatus as the image forming system is switched in operational mode into the mode in which a transparent image is formed. In other words, this proposal reduces the image formation system in productivity, being therefore not practical.

It has also been proposed to provide an image formation system with a recording medium conveyance bypass, which is parallel to the recording medium path of the fixing device of the transparent image forming apparatus, so that when the system is in the mode in which no transparent image is formed, recording medium is conveyed through the bypass to prevent the recording medium from being subjected to heat and pressure by the fixing device of the transparent image forming apparatus. This proposal also, however, is not practical for the following reason: That is, providing a fixing device with the bypass increases the fixing device in size. In other words a fixing device having the bypass is significantly larger in size than the one with no bypass, being therefore impractical to be used as the fixing device for a transparent image forming apparatus which does not have the mode in which no transparent image is formed.

Further, under certain conditions in terms of the combination of whether a color image is formed on only one or both surfaces of a sheet of recording medium, and whether a transparent image is formed on only one or both surfaces of the sheet of recording medium, the abovementioned image formation systems sometimes outputted images which were abnormally high in gloss. Thus, it has been desired to provide an image formation system capable of dealing with these issues.

SUMMARY OF THE INVENTION

Therefore, the primary object of the present invention is to provide an image formation system which is no different in structure and productivity, and yet, is capable of remaining roughly the same in the gloss level at which it outputs images, regardless of the combination of whether a color image is formed on only one or both surfaces of a sheet of recording medium, and whether a transparent image is formed on only one or both surfaces of the sheet of recording medium.

According to an aspect of the present invention, there is provided an image forming system comprising a non-transparent image forming apparatus including a first image forming station for forming a non-transparent toner image and for transferring the non-transparent toner image onto a recording material, first image heating means for heating a surface of the recording material which carries the toner image and which is discharged from said first image forming station, and first re-feeding means for re-feeding the recording material discharged from said first image heating means to said first image forming station with a reversed facing orientation; and a transparent image forming apparatus including a second image forming station for forming a transparent toner image and for transferring the transparent toner image onto the recording material discharged from said first image heating means, second image heating means for heating a surface of the recording material discharged from said second image forming station, second re-feeding means for re-feeding the recording material from said second image heating means to said second image forming station with a reversed facing orientation, wherein formation of images as a combination of the non-transparent image and the transparent image is capable on both sides of the recording material by controlling first re-feeding means and second re-feeding means; said image forming systems further comprising, first reversing means for feeding the recording material discharged from first image heating means to second image forming station with a reversed facing orientation, control means for controlling first reversing means in accordance with a combination of a non-transparent image formation process and a transparent image formation process for both sides of recording material so that the numbers of heating operations to which outermost layers of final fixed images are subjected to the first image heating means and second image heating means are the same.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
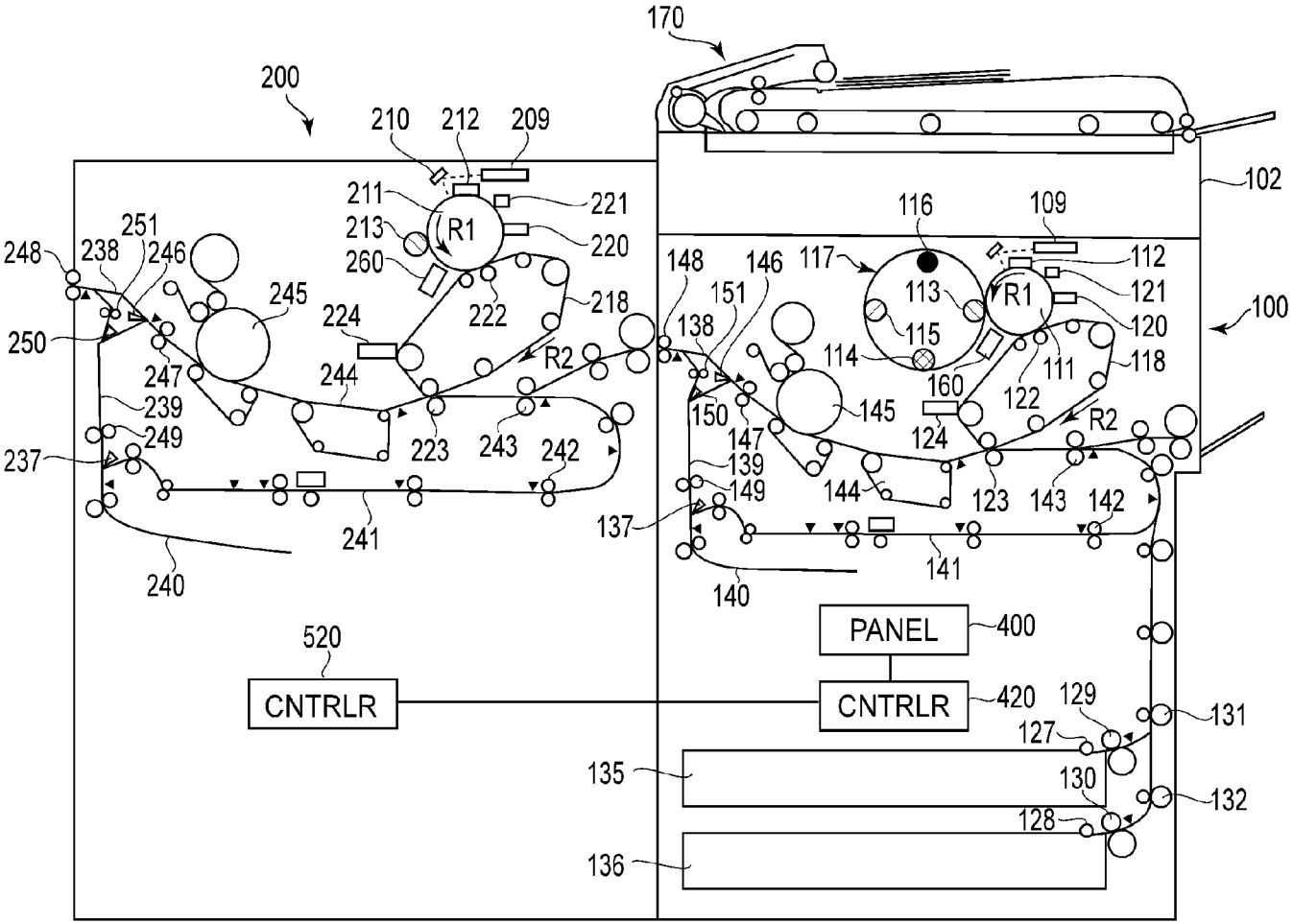
FIG. 1 is a schematic sectional view of the image formation system in the first preferred embodiment of the present invention, and shows its structure.

Hereinafter, the preferred embodiments of the present invention are described in detail with reference to the appended drawings. The preferred embodiments are not intended to limit the present invention in scope. That is, the present invention is also applicable to an image formation system which are partially or entirely different in structure from those in the preferred embodiment, as long as the system is structured so that when a transparent image is not formed, it turns recording medium upside down before it conveys the recording medium to its image formation station for forming a transparent image.

That is, the present invention is applicable to any image formation system regardless of the type of the charging method, developing method, transferring method, and cleaning method of the image forming station where a toner image is formed and transferred onto recording medium, regardless of whether the system is of the intermediary transfer type or direct transfer type, and regardless of whether the system is a monochromatic or full-color system. Further, with regard to the compatibility of the present invention with the image heating means of the image formation system, the application of the present invention is not limited to such a heating method that places a heating roller or the like in contact with an image, as long as the heating means is characterized in that the greater the number of times an image is directly heated by the image heating means, the glossier the image becomes.

What are going to be described are only the portions of the image formation system, which are essential to the formation and transfer of a toner image. However, the present invention is applicable to various image forming apparatuses, such as a printer, a copying machine, a facsimile machine, a multifunction image forming apparatus, etc., which are a combination of the portions of the image formation system, which are going to be described next, and additional devices, equipments, external shell, etc.

Incidentally, the general features of the image forming apparatuses disclosed in Japanese Laid-open Patent Applications 2009-190336 and 2007-328023, which are not directly related to the present invention, are not illustrated in the drawings, and are not going to be described.

<Image Formation System>

FIG. 1 is a schematic sectional view of a typical image formation system to which the present invention is applicable. It shows the general structure of the system. As is evident from FIG. 1, the image formation system comprises a non-transparent (color) image forming apparatus 100, and an image forming apparatus 200 for forming a clear (transparent) image (which hereafter will be referred to as transparent image forming apparatus 200). The transparent image forming apparatus 200 is an optional apparatus which is connectable to the downstream end of a primary image forming apparatus in terms of the recording medium conveyance direction. Hereafter, each of the structural components of the color image forming apparatus 100 is given a three-digit referential numeral, the first digit of which is "1", whereas each of the structural components of the transparent image forming apparatus 200 is given a three-digit numeral, the first digit of which is "2". Thus, it is only the color image forming apparatus 100 that is described in detail. That is, the structural features of the transparent image forming apparatus 200, which are the same as those of the color image forming apparatus, are not going to be described.

The color image forming apparatus 100 forms a full-color toner image by sequentially forming multiple monochromatic toner images, different in color, on the photosensitive drum 111 while keeping the secondary transfer roller 123 separated from the intermediary transfer belt 118, and then, transferring in layers the multiple monochromatic toner images onto the intermediary transfer belt 118. Then, the multiple monochromatic toner images, different in color, which make up a full-color toner image, on the intermediary transfer belt 118 are transferred together (secondary transfer) onto a sheet P of recording medium conveyed to the nip (secondary transfer station) between the secondary transfer roller 123 and intermediary transfer belt 118 after the secondary transfer roller 123 is placed in contact with the intermediary transfer belt 118.

After the transfer (secondary transfer) of the full-color toner image onto the sheet P of recording medium, the sheet P is conveyed to the first fixing device 145 by the conveyer belt 144. Then, the sheet P and the full-color toner image thereon are subjected to heat and pressure by the first fixing device 145, whereby the full-color image is fixed to the surface of the sheet P.

Each of the sheets P of recording medium in the recording medium cassette 135 is drawn out of the cassette 135 by the pickup roller 127 while being separated from the rest. Then, the sheet P is conveyed to the pair of registration rollers 143, which keep the sheet P on standby and release the sheet P with such a timing that the sheet P arrives at the nip between the secondary transfer roller 123 and intermediary transfer belt 118 at the same time as the full color toner image on the intermediary transfer belt 118.

The transparent image forming apparatus 200 receives the sheet P of recording medium after a color toner image is transferred onto the sheet P and fixed to the sheet P in the color image forming apparatus 100. Then, it transfers a transparent image onto the sheet P, and fixes the transparent toner image to the sheet P. Thus, as the sheet P on which a fixed color toner image is present is conveyed through the transparent image forming apparatus 200, the surface of the color image is covered with the transparent toner image. Consequently, the color image becomes uniform in gloss: the areas of the color image, which are not covered with color toners, become virtually the same in gloss as the areas of the color image, which are covered with color toners.

More specifically, the transparent image forming apparatus 200 forms a transparent toner image on the photosensitive drum 211, and transfers the transparent toner onto the intermediary transfer belt 218 from the photosensitive drum 211. Then, the transparent toner image on the intermediary transfer belt 218 is transferred (secondary transfer) onto the sheet P of recording medium which is conveyed to the nip (secondary transfer nip) between the secondary transfer roller 223 and intermediary transfer belt 218 after the secondary transfer roller 223 is placed in contact with the intermediary transfer belt 218.

After the transfer (secondary transfer) of the transparent toner image onto the full-color toner image on the intermediary transfer belt 218, the sheet P is conveyed into the second fixing device 245 by the conveyer belt 244, through which the sheet P is conveyed while being subjected to heat and pressure. Thus, the transparent image is fixed to the surface of the sheet P.

The first image forming station of the image formation system, that is, the image formation station of the color image forming apparatus 100, has the photosensitive drum 111. It has also the charging device 112 (corona discharger), exposing device 109, development rotary 117, primary transfer roller 122, and drum cleaning device 120, which are in the adjacencies of the peripheral surface of the photosensitive drum 111.

The photosensitive drum 111 comprises an aluminum cylinder and a photosensitive layer. The photosensitive layer is negatively chargeable and covers the entirety of the peripheral surface of the photosensitive drum 111. The photosensitive drum 111 is rotated at a preset peripheral velocity (process speed) in the direction indicated by an arrow mark R1. The charging device 112 uniformly charges the peripheral surface of the photosensitive drum 111 to the negative polarity. The exposing apparatus 109 writes an electrostatic latent image of the image to be formed, on the uniformly charged portion of the peripheral surface of the photosensitive drum 111 by scanning the uniformly charged portion of the peripheral surface of the photosensitive drum 111 with a beam of laser light which it emits while deflecting the beam with a rotational mirror. The development rotary 117 holds the yellow, magenta, cyan, and black developing devices 113, 114, 115, and 116, respectively. It is capable of positioning each developing devices in the development station in which the electrostatic latent image on the photosensitive drum 111 is developed into a monochromatic toner image of yellow, magenta, cyan, or black color. Each developing device develops the electrostatic latent image on the photosensitive drum 111 with the use of two-component developer, which is a mixture of the yellow, magenta, cyan, or black toner, and carrier.

The primary transfer roller 122 forms the primary transfer station between the photosensitive drum 111 and intermediary transfer belt 118, by being pressed upon the inward surface of the intermediary transfer belt 118. The toner image on the photosensitive drum 111, which is negative in polarity, is transferred (primary transfer) onto the intermediary transfer belt 118 by the application of positive DC voltage to the primary transfer roller 122.

The drum cleaning device 120 recovers the transfer residual toner, that is, the toner which escaped from being transferred onto the intermediary transfer belt 118 from the peripheral surface of the photosensitive drum 111 and therefore, is remaining on the peripheral surface of the photosensitive drum 111. The belt cleaning device 124 recovers the transfer residual toner, that is, the toner which escaped from being transferred onto the sheet P of recording medium from the intermediary transfer belt 118, and therefore, is remaining on the intermediary transfer belt 118. During the process in which the multiple (four) monochromatic toner images, different in color, are transferred in layers onto the intermediary transfer belt 118, the belt cleaning device 124 and secondary transfer roller 123 are kept separated from the intermediary transfer belt 118. Then, they are placed in contact with the intermediary transfer belt 118 just before the point in time at which the area of the intermediary transfer belt 118, which is covered with the transfer residual toner from the second transfer, reaches the belt cleaning device 124.

The second image forming station of the image formation system, that is, the image forming station of the transparent image forming apparatus 200, has the photosensitive drum 211. It has also the charging device 212 (corona discharger), exposing device 209, developing device 213, primary transfer roller 222, and drum cleaning device 220, which are in the adjacencies of the peripheral surface of the photosensitive drum 211.

The photosensitive drum 211 comprises an aluminum cylinder and a photosensitive layer. The photosensitive layer is negatively chargeable and covers the entirety of the peripheral surface of the photosensitive drum 211. The photosensitive drum 211 is rotated at a preset peripheral velocity (process speed) in the direction indicated by an arrow mark R1. The charging device 212 uniformly charges the peripheral surface of the photosensitive drum 211 to the negative polarity. The exposing apparatus 209 writes an electrostatic latent image of the image to be formed, on the uniformly charged portion of the peripheral surface of the photosensitive drum 211 by scanning the uniformly charged portion of the peripheral surface of the photosensitive drum 211 with a beam of laser light which it emits while deflecting the beam with a rotational mirror. The developing device 213 develops the electrostatic latent image on the photosensitive drum 211 with the use of two-component developer, which is a mixture of transparent toner, and carrier.

The primary transfer roller 222 forms the primary transfer station between the photosensitive drum 211 and intermediary transfer belt 218 by being pressed upon the inward surface of the intermediary transfer belt 218. The toner image on the photosensitive drum 211, which is negative in polarity, is transferred (primary transfer) onto the intermediary transfer belt 218 by the application of positive DC voltage to the primary transfer roller 222.

The drum cleaning device 220 recovers the transfer residual toner, that is, the toner which escaped from being transferred onto the intermediary transfer belt 218 from the peripheral surface of the photosensitive drum 211 and therefore, is remaining on the peripheral surface of the photosensitive drum 211. The belt cleaning device 224 recovers the transfer residual toner, that is, the toner which escaped from being transferred onto the sheet P of recording medium from the intermediary transfer belt 218, and therefore, is remaining on the intermediary transfer belt 218.

<Fixing Device>

Figure 2:
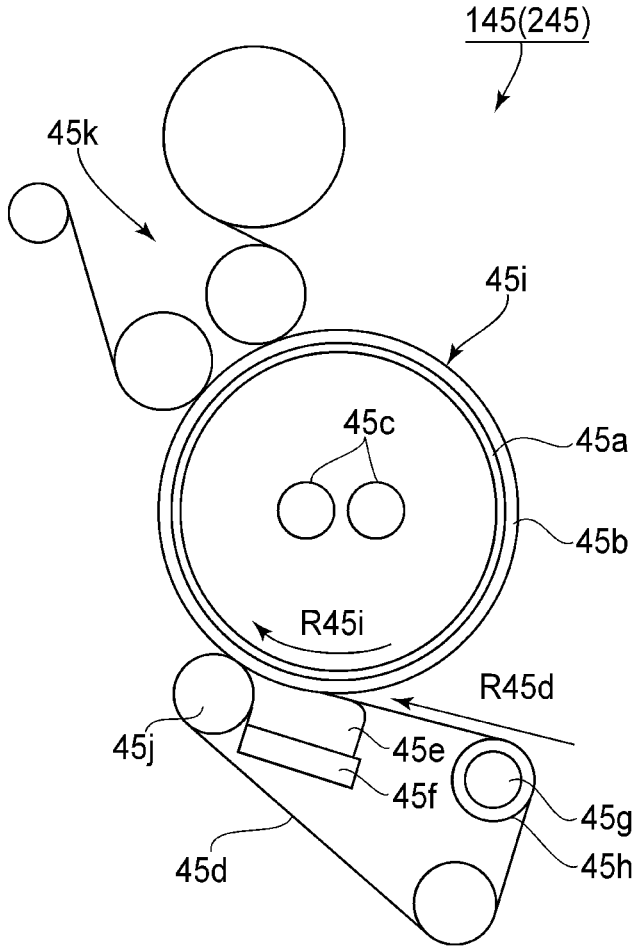
FIG. 2 is a schematic sectional view of the fixing device in the first preferred embodiment of the present invention, and is for describing the structure of the fixing device.

FIG. 2 is a drawing for describing the structure of the fixing device. As will be evident from FIG. 2, the first fixing device 145, that is, the fixing device of the color image forming apparatus 100, and the second device 245, that is, the fixing device of the transparent image forming apparatus 200, is the same in structure. Hereafter, therefore, only the first fixing device 145, which is an example of the first image heating means, is described. In other words, the second fixing device 245, which is an example of the second heating means, is not described to avoid the repetition of virtually the same description.

The first fixing device 145 comprises a heat roller 45*i* and a pressure belt 45*d*. The heat roller 45*i* is rotated in the direction indicated by an arrow mark R45*i*. The pressure belt 45*d* is rotated in the direction indicated by an arrow mark R45*d*. The pressure belt 45*d* is pressed upon the heat roller 45*i*, forming thereby a heat application nip in which heat is applied to the sheet P of recording medium.

The heat roller 45*i*, which is an example of a heating member, comprises an aluminum cylindrical member 45*a* and an elastic layer 45*b*. The elastic layer 45*b* is for making the heat roller 45*i* uniform in the pressure distribution in the heat application nip, by accommodating the peaks and valleys of the image bearing surface of the sheet P of recording medium. It is formed of silicon rubber, and covers the entirety of the peripheral surface of the cylindrical member 45*a*. Further, the first fixing device 145 has a pair of halogen heaters 45*c*, which are roughly at the center of the hollow of the cylindrical member 45*a* of the heat roller 45*a*. The halogen heaters 45*c* heat the cylindrical member 45*a*, whereby they heat the image bearing surface of the sheet P of recording medium through the elastic layer 45*b*. While the first fixing device 145 is in operation, the electric power supplied to the halogen heaters 45*c* is adjusted so that the surface temperature of the elastic layer 45*b* remains within a range of 120° C.±2.5° C. The heat roller 45*i* is rotated by an unshown fixation motor connected to one end of the shaft of the heat roller 45*i*.

The pressure belt 45*d*, which is an example of a pressure applying member, is stretched around multiple belt supporting rotational members, being thereby supported by the rotational members. It is kept in contact with the heat roller 45*i*, and is rotated by the rotation of the heat roller 45*i*. The pressure roller 45*j* and pressure pad 45*e* keep the outward surface of the pressure belt 45*d* pressed on the heat roller 4*ti* by pressing on the inward surface of the pressure belt 45*d*, forming thereby a heating nip which comprises the area of contact between the pressure pad 45*e* and pressure belt 45*d*, and the area of contact between the pressure roller 45 and pressure belt 45*d*. The pressure pad 45*e* is formed of silicon rubber, being therefore capable of deforming to make uniform the pressure distribution in the area of contact between the pressure pad 45*e* and the pressure belt 45*d* (or peripheral surface of heat roller 45*i*). The pressure pad 45*e* is solidly attached to the pressure pad supporting plate 45*f* which extends through the loop, which the pressure belt 45*d* forms, from one edge of the pressure belt 45*d* to the other. In order to minimize the amount of friction between the pressure pad 45*e* and pressure belt 45*d*, the pressure pad 45*d* is covered with the unshown sheet of fluorinated resin.

There is a halogen heater 45*g* in the center of the belt supporting rotational member 45*h* so that the halogen heater 45*g* prevents the heat belt 45*d* from reducing in temperature, through the belt supporting rotational member 45*h*. While the fixing device 145 is in operation, the amount by which electric power is supplied to the halogen heater 45*g* is adjusted so that the surface temperature of the pressure belt 45*d* remains within a range of 80° C.±2.5° C.

<Recording Medium Recirculation Mechanism>

Referring to FIG. 1, the color image forming apparatus 100 is provided with the first sheet recirculating means for forming a color image on the reverse side of the sheet P of recording medium. The first sheet recirculating means is on the downstream side of the first fixing device 145 in terms of the recording medium conveyance direction. The transparent image forming apparatus 200 is provided with the second sheet recirculating means for forming a transparent image on the reverse side of the sheet P. The second sheet recirculating means is on the downstream side of the second fixing device 245 in terms of the recording medium conveyance direction. Here, only the first recording medium recirculating means is described to avoid repetition of the same description.

The sheet discharge flapper 146 guides the sheet P of recording medium into either the recording medium conveyance path 138 or recording medium turning path 139 after the discharging of the sheet P from the fixing device 145. When the color image forming apparatus 100 is in the mode for forming a color image on both surfaces of the sheet P, the flapper 145 is kept in the upward position so that the sheet P moves into the recording medium turning path 139 after the sheet P is conveyed to the flapper 145 by the pair of internal discharge rollers 147. The recording medium turning path 139 guides the sheet P into the path 140 which is for turning the sheet P around while turning the sheet P upside down.

Thereafter, the flapper 137 is switched in position, and then, the sheet P of recording medium is reversed in direction, whereby the sheet P is guided into the aforementioned path 141 while remaining upside down. There is a pair of sheet recirculation rollers 142 at the downstream end of the sheet recirculation path 141 in terms of the recording medium conveyance direction. The sheet recirculation rollers 142 are for feeding again the sheet P into the nip (secondary transfer station) between the secondary transfer roller 123 and intermediary transfer belt 118.

<Sheet Turning Mechanism>

In the two-sided mode, the sheet P of recording medium is reversed in the conveyance direction after the first image formation on the sheet P. Thus, if a print made in the two-sided mode is layered on a print made in the one-sided mode, the second print has to be turned around later so that the top edge of the second print aligns with the top edge of the first print. Thus, the color image forming apparatus 100 and transparent image forming apparatus 200 are provided with a sheet turning mechanism which turns the sheet P around so that the edge of the sheet P, which was the leading edge when an image was formed on the first surface of the sheet P, becomes the leading edge again. In particular, the sheet turning mechanism of the transparent image forming apparatus 200 is designed so that it operates according to whether a color image is formed on only one or both surfaces of the sheet P and whether a transparent image is formed on only one or both surface of the sheet P. More specifically, it is designed so that the sheet P is discharged face down, that is, the sheet P is discharged so that the first surface of the sheet P, in terms of the order in which an image is formed on the two surfaces of the sheet P, faces downward, and the second surface of the sheet P faces upward.

The outward pair of sheet discharge rollers 148 are in the adjacencies of the sheet discharge flapper 148. They discharge the sheet P of recording medium out of the color image forming apparatus 100 after the sheet P is guided into the sheet conveyance path 138 by the sheet discharge flapper 146. When it is necessary to turn the sheet P over before discharging the sheet P from the color image forming apparatus 100, the sheet discharge flapper 146 is tilted upward so that the sheet P is conveyed by the sheet turning rollers 149 into the sheet turning path 139 far enough for the trailing edge of the sheet P to almost pass the sheet turning flapper 150. Then, the sheet turning flapper 150 is switched in position, and the sheet turning rollers 149 are rotated in reverse. Consequently, the sheet P is conveyed upside down to the outward discharge rollers 148.

Figure 3:
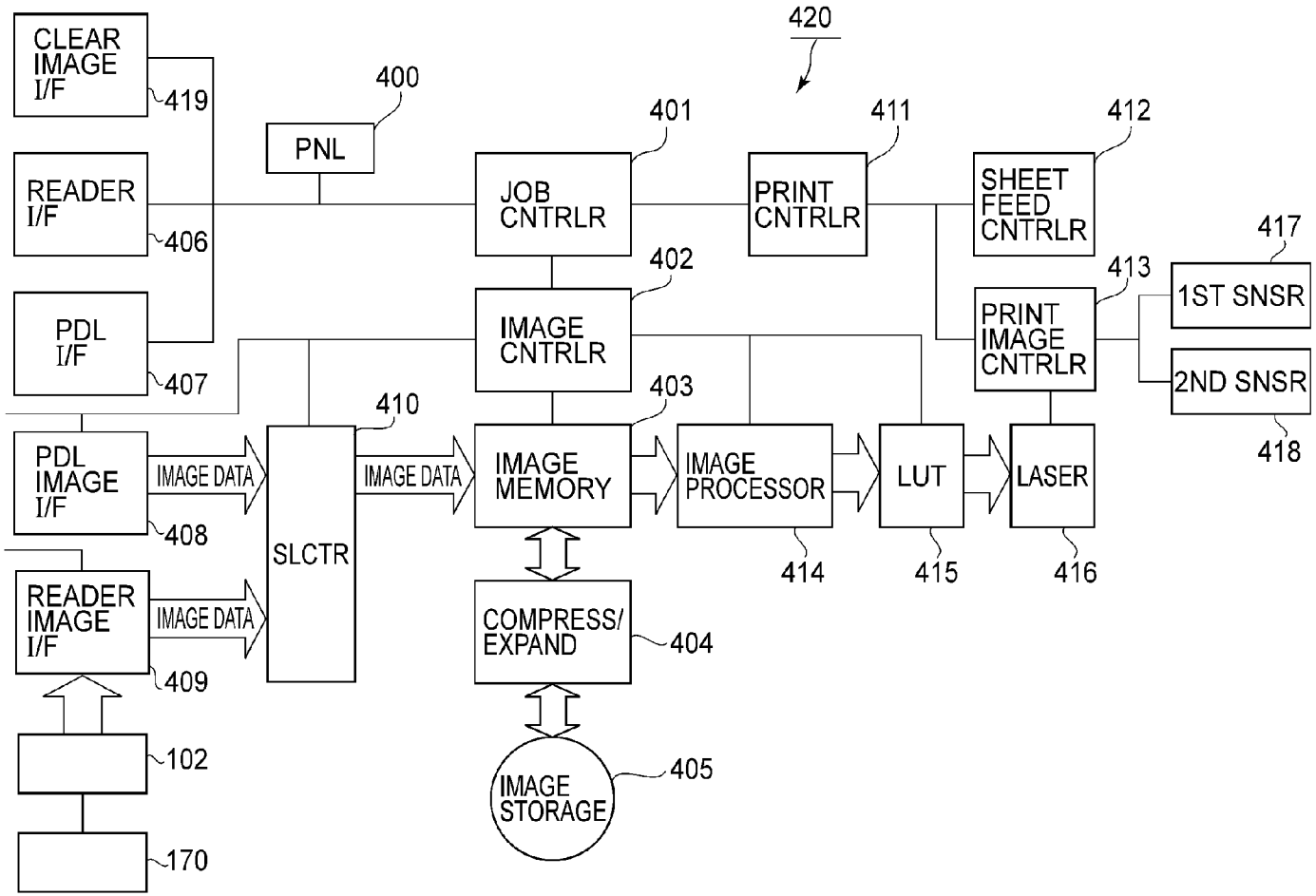
FIG. 3 is a block diagram of the color image forming apparatus in the first preferred embodiment, and illustrates the control system of the apparatus.

FIG. 3 is a block diagram of the control system of the color image forming apparatus 100. As is evident from FIG. 3, the job control section 401 is a circuit which has: ROMs which store the programs for controlling the color image forming apparatus 100; RAMs in which the programs are developed; CPU which carries out the programs; etc. The job control section 401 controls the overall operation of the color image forming apparatus 100.

The control panel 400 is in connection to the job control section 401. The instructions given through the control panel 400 are given to the job control section 401. Then, an operational sequence for copying, printing, or the like is generated by the programs in the job control section 401 according to the operational mode inputted through the control panel 400.

The job control section 401 is in connection to the reader control communication I/F 406, which is the communication I/F with the unshown CPU circuit which controls the image reading device 102; and the transparent image forming apparatus control communication I/F which controls the transparent image forming apparatus 200. Referring to FIG. 1, the color image forming apparatus 100 has an image reading device 102 which has an original feeding device 170. The image reading device 102 reads one by one the originals set in a bundle in the original feeding device 170.

The job control section 401 is in connection to the PDL control communication I/F 407, which is the communication I/F between the job control section 401 and CPU circuit of the unshown PDL image control section which develops the PDL image data sent from an unshown personal computer or the like, into a bit map image. Further, the job control section 401 is in connection to the image control section 402 which controls the image data for sending the PDL image and reader image to each of the development stations of the color image forming apparatus 100, and the print control section 411 which forms an image by controlling various load.

The image control section 402 is a circuit which sets up each circuit related to image formation, according to the job operation sequence generated by the job control section 401. It is to the image control section 402 that the PDL image data are sent from the PDL image I/F 408, and the reader image data are sent from the reader image I/F 409.

The image control section 402 sets up an image selector 410, which determines which image data are to be made effective in the image memory 403 which is a volatile memory. Further, it determines in which region of the image memory 403 the image data from the image selector 410 are to be stored. Further, the image control section 402 sets up the image storage 405 which is made up of nonvolatile memory, such as a HDD. It also compresses the bit map image data from the image memory 403, and sends the compressed image data to the image storage section 405. Further, it sets up the image compression-expansion section 405 which expands the compressed image data from the image storage 405 and returns the expanded image data to the image memory 304.

In order to actually develop the image data and form an image based on the developed image data, the image control section 402 reads the color image data from the image memory 403, and makes the image processing section 414 to carry out a desired image forming operation. The print control section 411 receives the final data for forming each monochromatic image, which is sent by the print image control section 413, according to the settings determined by the image control section 402 in response to the instruction from the job control section 401, and issues a command to the print image control section 413. The print image control section 413 sends image data to the exposure control section 416.

The print image control section 413 sets up a LUT (look up table) which reflects the change in the sensitivity of the photosensitive drum, following the instruction from the print control section 411.

The LUT 415 is for enabling the color image forming apparatus 100 to output an image with a desired image density, based on the inputted image data, in a case where because of the changes in the sensitivity of the photosensitive drum, intensity of beam of laser light, amount of charge from the primary charging device, and/or the like factors, the color image forming apparatus 100 might fail to output an image with the desired image density. Because the image data are outputted to the exposure control section 416 by way of the LUT 415, an electrostatic latent image is formed, for each primary color, on the photosensitive drum 111 so that as the electrostatic latent image is developed by one of the developing devices 113-116, a toner image with the desired image density is effected.

The print control section 411 makes the recording medium conveyance control section 412 convey the sheet P of recording medium in synchronism with the print image control section 413, so that the full-color toner image on the intermediary transfer belt 118 is transferred onto the correct location of the sheet P. Further, the print control section 411 controls the image formation system so that an image is formed on the sheet P of recording medium through the first fixing device 145. The print image control section 413 is in contact with the first and second patch sensors 417 and 418.

Figure 4:
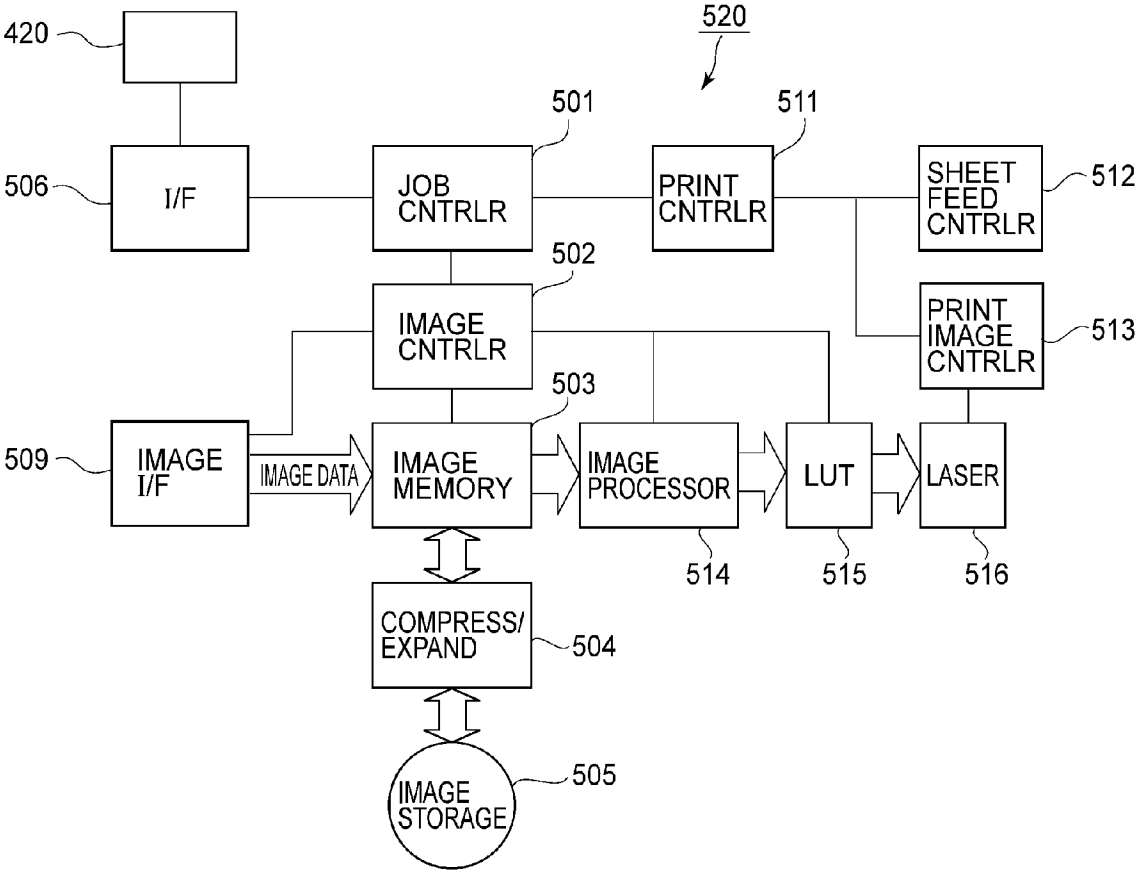
FIG. 4 is a block diagram of the transparent image forming apparatus in the first preferred embodiment, and shows the control system of the apparatus.

FIG. 4 is a block diagram of the control system of the transparent image forming apparatus 200. It roughly shows the control system of the transparent image forming apparatus 200.

Referring to FIG. 4, the job control section 501 is a circuit which comprises: ROMs in which the programs for controlling the transparent image forming apparatus 200 are stored; RAMs in which the programs are developed; CPU which carries out the programs; etc. The job control section 501 forms images by driving each load by controlling the print control section 511 and image control section 502.

The main assembly control communication I/F 506 is in connection to the job control section 501. It is through the main assembly control communication I/F 506 that the instruction from the color image forming apparatus 100 is transmitted to the image control section 501.

The operation for forming a transparent image on one of the two surfaces of the sheet P of recording medium, an operation for forming a transparent image on both surfaces of the sheet P, etc., are carried out by the programs in the image control section 501 in the selected operational mode.

The image control section 502 develops the image data sent from the main assembly image I/F 509 by way of the main assembly image I/F 509, into a bit map image. The image control section 502 is a circuit which controls each of the circuits related to image formation, following the job sequence generated by the job control section 501. The image data to be sent to the image control section 502 from the main assembly image I/F 509 are stored in the image memory 503.

Further, the image control section 502 sets up the image storage 505 which is made up of nonvolatile memory, such as a HDD. It also compresses the bit map image data from the image memory 503, and sends the compressed image data to the image storage section 505. Further, it sets up the image compression-expansion section 505 which expands the compressed image data from the image storage 505 and returns the expanded image data to the image memory 304. Further, in order to actually develop the image data and form an image based on the developed image data, the image control section 502 reads the transparent color image (clear coat) data from the image memory 503, and makes the image processing section 514 to carry out a desired image forming operation.

The print control section 511 receives the final data for forming each monochromatic image, which is sent by the print image control section 513, according to the settings determined by the image control section 502 in response to the instruction from the job control section 501, and issues a command to the print image control section 513. The print image control section 513 sends image data to the exposure control section 516.

The print image control section 513 sets up a LUT (look up table) which reflects the sensitivity of the photosensitive drum, following the instruction from the print control section 511. The image data are outputted to the laser 516 by way of the LUT 515, and an electrostatic latent image is formed, for each primary color, on the photosensitive drum 211.

The print control section 511 controls the recording medium conveyance control section 512 in the following manner. That is, it makes the recording medium conveyance control section 512 convey the sheet P of recording medium in synchronism with the print image control section 513, so that a transparent (clear) toner image on the intermediary transfer belt 218 is transferred onto the correct location of the sheet P conveyed from the color image forming apparatus 100. Further, the print control section 511 causes the sheet P to be conveyed through the second fixing device 245 so that the transparent (clear) toner image is fixed to the sheet P.

By the way, recently, it has come to be strongly desired to increase a full-color image forming apparatus in image quality, more specifically, the quality of a photographic image. In addition, a digital camera has come to be widely used. Thus, demand has been increasing for a full-color image forming apparatus capable of outputting a full-color image which is as high in image quality as a photographic image.

The image formation system shown in FIG. 1 is a combination of the color image forming apparatus 100, and the transparent image forming apparatus 200 connected in series to the color image forming apparatus 100. Thus, it is capable of outputting an image which is as high in image quality as a photographic image, on the sheet P of recording medium, and then, forming a toner image, which becomes transparent (clear) as it is fixed, on the sheet P on which the high quality image has just been formed. Further, for the operational ease and efficiency, the image formation system, which is the combination of the color image forming apparatus 100, and the transparent image forming apparatus 200 connected in series to the color image forming apparatus 100, the system is designed so that the transparent image forming apparatus 200 can be made to turn the sheet P upside down before it outputs the sheet P.

This control, however, is intended to improve the system in productivity and operational ease. That is, the glossiness of the image is not in consideration. Besides, some jobs do not require the formation of a transparent image. In the case of a conventional image formation sequence which does not form a transparent image, an image is formed by the color image forming apparatus 100 on only one surface of the sheet P of recording medium, and then, the sheet P is discharged from the color image forming apparatus 100. Then, the sheet P is conveyed through the second fixing device 245, that is, the fixing device of the transparent image forming apparatus 200, in such a manner that the surface of the sheet P, on which the color image is present, faces the fixation roller (45*i* in FIG. 2). This method, however, is problematic in that the areas of the sheet P, on which the color toners are present, become excessively glossy compared to the areas of the sheet P, on which no toner is present.

In the following preferred embodiments of the present invention, the image formation system are designed so that an image can be improved in gloss by the transparent image forming apparatus 200 without causing the areas of the sheet P of recording medium, on which toner is present, to excessively increase in gloss compared to the areas of the sheet P, on which no toner is present. More specifically, the sheet turning first means, that is, the sheet turning means of the color image forming apparatus 100, and the sheet turning second means, that is, the sheet turning means of the transparent image forming apparatus 200, are controlled according to the combination of the image formation mode of the color image forming apparatus 100, and the image formation mode of the transparent image forming apparatus 200.

Embodiment 1

Figure 5:
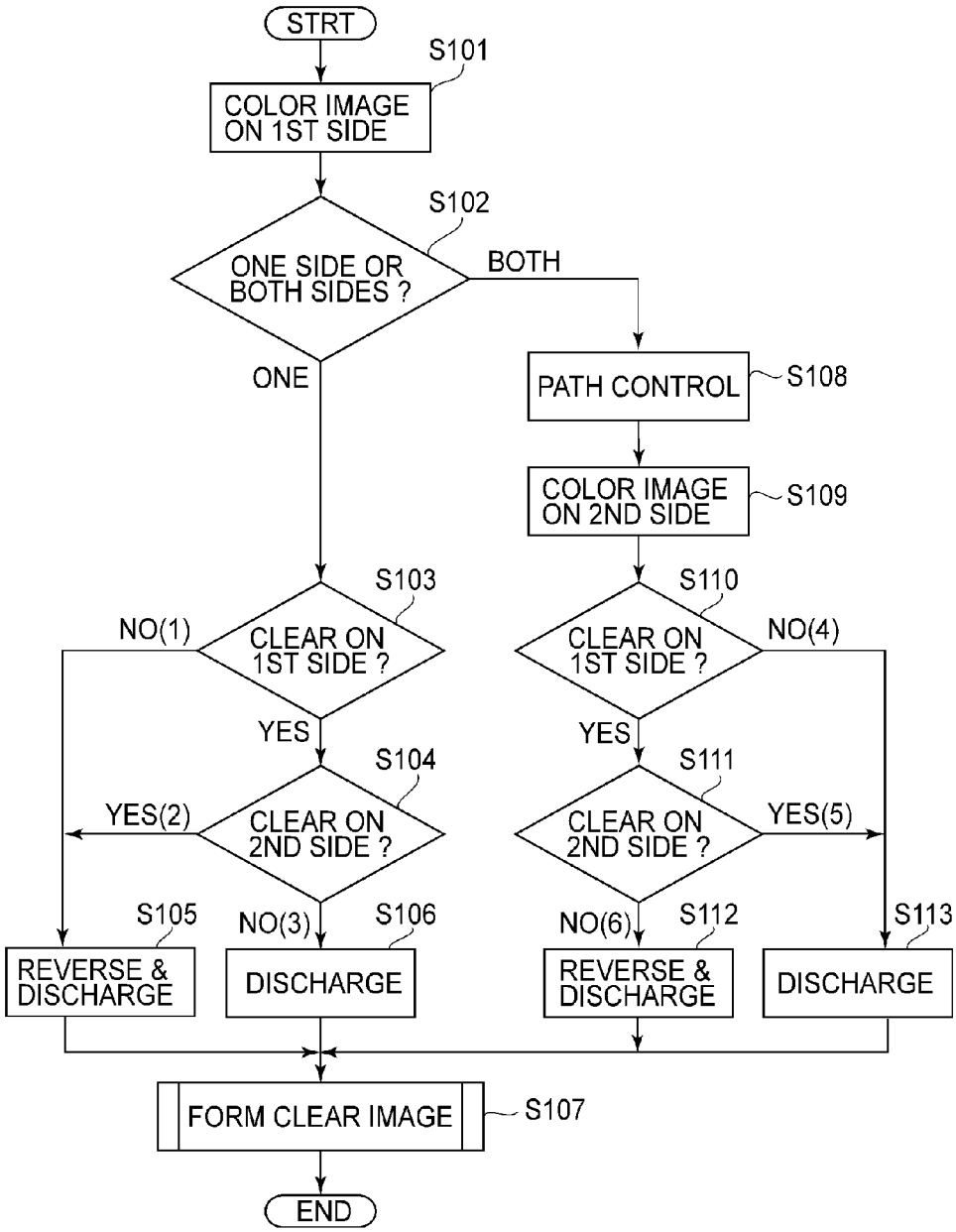
FIG. 5 is a flowchart of the color image forming apparatus in the first preferred embodiment of the present invention, and shows the operational sequence of the apparatus.
Figure 6:
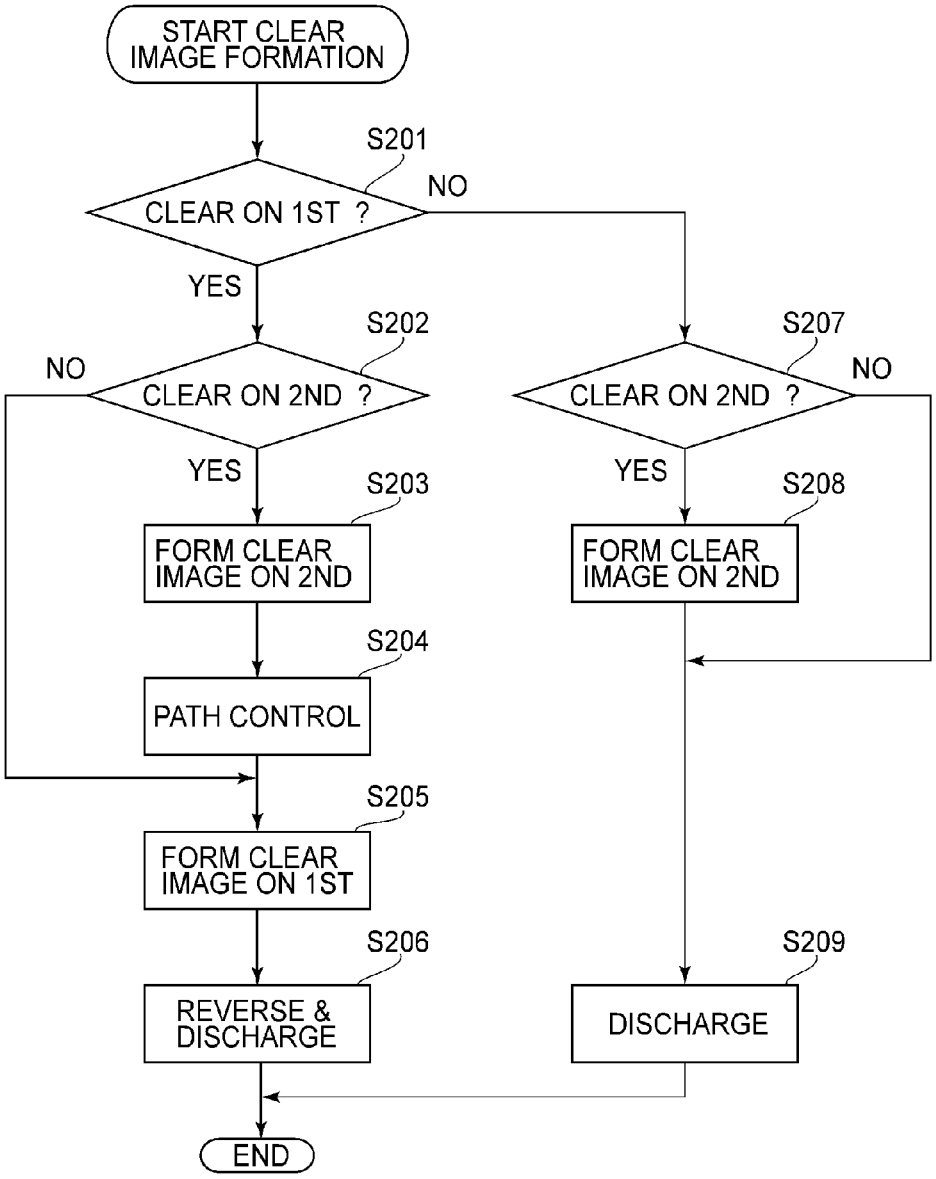
FIG. 6 is a flowchart of the transparent image forming apparatus, in the first preferred embodiment of the present invention, and shows the operational sequence of the apparatus.

FIG. 5 is a flowchart of the control sequence of the color image forming apparatus 100 in the first preferred embodiment. FIG. 6 is a flowchart of the control sequence of the transparent image forming apparatus 200 in the first preferred embodiment.

Referring to FIG. 1, in the first embodiment, the color image forming apparatus 100 and transparent image forming apparatus 200 are directly and separably in connection with each other.

The color image forming apparatus 100 has the first image formation station (118), first fixing device 145, sheet recirculation path 141, and sheet turning path 139. The color image forming apparatus 100 forms a color toner image on the sheet P of recording medium in the first image formation station (118), and discharges the sheet P from the first image formation station (118). Then, it rotates the heat roller 45*i*, which is an example of a heating member, in contact with the surface of the sheet P with the color toner image, to fix the color toner image.

The first image formation station (118) forms a color toner image, and transfers the color toner image onto the intermediary transfer belt 118 in the secondary transfer nip between the intermediary transfer belt 118 and secondary transfer roller 123. Then, it discharges the sheet P from the secondary transfer nip. Then, the first fixing device 145 fixes the color toner image on the sheet P by rotating the heat roller (45*i* in FIG. 2) while keeping the heat roller in contact with the surface of the sheet P on which the color toner image is present. The sheet recirculation path 141, which is an example of the first sheet recirculating means, is capable of turning the sheet P upside down in such a manner that the edge of the sheet P, which was the leading edge in terms of the recording medium conveyance direction when the sheet P was discharged from the first fixing device 145, will become the trailing edge, and then, re-feeding the sheet P into the secondary transfer nip between the intermediary transfer belt 118 and secondary transfer roller 123.

The transparent image forming apparatus 200 has the second image formation station (218), second fixing device 245, sheet recirculation path 241, and sheet turning path 239. It is capable of forming a transparent toner image in the second image formation station (218), and then, transferring the transparent toner image onto the sheet P of recording medium, which has just been discharged from the first fixing device 145. Further, the second fixing device 245 is capable of fixing the transparent toner image formed on the sheet P discharged from the fixing device 145, by rotating the heat roller 45*i* while keeping the heat roller 45*i* in contact with the surface of the sheet P, on which the transparent toner image is present, after the discharging of the sheet P from the second image formation station (218).

The second image formation station (218) is capable of forming a transparent toner image, transferring the transparent toner image onto the intermediary transfer belt 218 in the secondary transfer nip between the intermediary transfer belt 218 and secondary transfer roller 223, and discharging the sheet P from the secondary transfer nip. The second fixing device 245 is capable of fixing the color toner image on the sheet P by rotating the heat roller (45*i* in FIG. 2) while keeping the heat roller in contact with the surface of the sheet P, on which the color toner image is present. The sheet recirculation path 241, which is an example of the second sheet recirculating means, is capable of turning the sheet P over in such a manner that the edge of the sheet P, which was the downstream edge in terms of the recording medium conveyance direction when the sheet P was discharged from the second fixing device 245, will become the upstream edge, and then, re-feeding the sheet P into the secondary transfer nip between the intermediary transfer belt 218 and secondary transfer roller 223.

The sheet recirculation path 141, which is an example of the first sheet recirculating means, is capable of turning the sheet P over in such a manner that the edge of the sheet P, which was the trailing edge in terms of the recording medium conveyance direction when the sheet P was discharged from the first fixing device 145, will become the leading edge, and then, re-feeding the sheet P into the first image formation station (118), after the discharging of the sheet P from the first fixing device 145.

The sheet recirculation path 241, which is an example of the second sheet recirculating means, is capable of turning the sheet P over in such a manner that the edge of the sheet P, which was the trailing edge in terms of the recording medium conveyance direction when the sheet P was discharged from the second fixing device 245, will become the leading edge, and then, re-feeding the sheet P into the second image formation station (218), after the discharging of the sheet P from the second fixing device 245.

The sheet turning path 139, which is an example of the first sheet turning means, and the sheet turning flapper 150, are capable of turning the sheet P over in such a manner that the edge of the sheet P, which was the trailing edge in terms of the recording medium conveyance direction when the sheet P was discharged from the first fixing device 145, will become the leading edge, and then, re-feeding the sheet P into the second image formation station (218).

The sheet turning path 239, which is an example of the second sheet turning means, and the sheet turning flapper 250, are capable of turning the sheet P over in such a manner that the edge of the sheet P, which was the trailing edge in terms of the recording medium conveyance direction when the sheet P was discharged from the second fixing device 245, will become the leading upstream edge, and then, discharging the sheet P in such a manner that the surface of the sheet P, on which the toner image is present, faces downward (face-down discharge).

The control 420 controls the sheet turning path 139 according to the combination between whether a color image is formed on only one or both surfaces of the sheet P of recording medium, and whether a transparent image is formed on only one or both surfaces of the sheet P, in such a manner that the total number of times the topmost layer of the image on the sheet P comes into contact with the heat roller 45*i* of the first fixing device 145 becomes the same as the total number of times the topmost layer of the image on the sheet P comes into contact with the heat roller 45*i* of the second fixing device 245.

Further, in order to make the image formation system to discharge the prints in such a manner that after the discharging of multiple sheets P of recording medium from the second fixing device 245, they face the same direction, the control 420 controls the image formation system according to the combination of whether a color image is on one or both surfaces of the sheet P of recording medium, and whether a transparent image is on one or both surfaces of the sheet P.

Referring to FIG. 5 as well as FIG. 1, as the control 420, that is, the control of the color image forming apparatus 100, receives an image formation command, first, it forms a color image on one of the two surfaces of the sheet P of recording medium (S101). After the formation of the color image, the control 420 determines whether the on-going image forming operation is to be ended after the formation of the color image on only one (first) of the two surfaces of the sheet P, or to be continued to form a color image on the other (second) surface of the sheet P (S102).

If it determines that a color image was to be formed on only one surface of the sheet P (single sided in S102), the control 420 determines whether it is necessary to turn the sheet P upside down before forming a transparent toner image, based on the command sent from the control of the image formation system (S103, S104).

(1) When neither the first or second surface of the sheet P require the formation of a transparent image (No in S103), the sheet P is turned upside down before it is discharged (S105).

(2) When a transparent image is required not only on the first surface of the sheet P (Yes in S103), but also, on the second surface (S104), the sheet P is discharged after being turned upside down (S105).

(3) When the first surface requires a transparent image (Yes in S103), but, the second surface does not require a transparent image (No in S104), the sheet P is discharged without being turned upside down (S106).

On the other hand, when a color image is formed on both surfaces of the sheet P of recording medium (two-sided in S102), first, the control 420 makes the color image forming apparatus 100 form a color image on the first surface of the sheet P, and then, guides the sheet P into the sheet turning path 139 so that the sheet P is delivered to the sheet recirculation path 141 to form an image on the second surface of the sheet P (S108). Then, the control 420 determines whether the sheet P needs to be turned over before the formation of a transparent image, based on the instruction regarding whether or not a transparent image is to be formed. Then, it turns the sheet P over in such a manner that the edge of the sheet P, which was the leading edge when the sheet P was discharged from the fixing device, becomes the trailing edge. Then, it transfers a color toner image onto the second surface of the sheet P, and fixes the color toner image (S109).

(4) When it is unnecessary to form a transparent image on the first surface of the sheet P of recording medium (No in S110), the sheet P is simply discharged from the image formation system (S113).

(5) When it is necessary to form a transparent image on the first surface of the sheet P (Yes in S110), and also, on the second surface of the sheet P (Yes in S111), the sheet P is simply discharged (S113).

(6) When it is necessary to form a transparent image on the first surface of the sheet P (Yes in S110, but is not necessary to form a transparent image on the second surface of the sheet P (No in S111), the sheet P is turned over before it is discharged (S112).

As the sheet P is discharged from the color image forming apparatus 100 after being put through one of the image formation sequences (1)-(6), it is passed to the transparent image forming apparatus 200 so that it can be process by the apparatus 200 (S107).

Next, referring to FIG. 6 as well as FIG. 1, the control 520 determines whether it is necessary to form a transparent image on the first surface of the sheet P or not, based on the command data from the main assembly. If it determines that it is necessary to form a transparent image on the first surface (Yes in S201), it determines whether or not it is necessary to form a transparent image on the second surface of the sheet P, based on the command data from the main assembly (S202).

If the control 520 determines that it is necessary to form a transparent image on the second surface of the sheet P (Yes in S202), a transparent image is formed on both surfaces of the sheet P. Since the color image forming apparatus 100 has positioned the sheet P so that a transparent image is formed on the second surface of the sheet P, a transparent image is formed on the second surface (S203). Then, after the formation of a transparent image on the second surface, the sheet P is guided into the sheet turning path 139, and is passed onto the sheet recirculation path 141 (S204). Then, a transparent image is formed on the first surface of the sheet P (S205).

Thereafter, the sheet P of recording medium is discharged from the second fixing device 245, turned upside down, and discharged (S206). More specifically, the sheet P is conveyed into the sheet turning path 239, is turned upside down by the sheet turning flapper 250, and is discharged from the transparent image forming apparatus 200, ending the image formation sequence.

When it is unnecessary to form a transparent image on the second surface of the sheet P (No in S202), a transparent image is formed on the first surface (S205). Then, the sheet P is discharged from the second fixing device 245, turned upside down, and discharged (S206), ending the image formation sequence.

On the other hand, when it is unnecessary to form a transparent image on the first surface of the sheet P (No in S202), the control 520 determines whether or not it is necessary to form a transparent image on the second surface, based on the command data from the main assembly (S207).

When it is necessary to form a transparent image on the second surface (Yes in S207), a transparent image is formed on the second surface (S208). Then, the sheet P is simply discharged from the transparent image forming apparatus 200 (S209), ending the image formation sequence.

When it is unnecessary to form a transparent image on the second surface (No in S207), the sheet P is simply discharged from the transparent image forming apparatus 200 (S209), ending the image formation sequence.

Embodiment 2

In the first preferred embodiment of the present invention described above, the image formation system had six operational modes. In the second preferred embodiment of the present invention, the image formation system has additional two image formation modes, that is, it has eight image formation modes.

Referring to FIG. 1, the control 420 controls the sheet turning first means (146, 150, 139, 149) according to the combination of whether a color image is going to be formed on only one or both surfaces of the sheet P of recording medium, and whether a transparent toner image is formed on only one or both surfaces of the sheet P. With the use of this control method, the total number of times the topmost layer of the fixed image comes into contact with the heat roller (45*i* in FIG. 2) of the first fixing device 145 and the total number of times the topmost layer of the fixed image comes into contact with the heat roller (45*i* in FIG. 2) of the second fixing device 245 become only once.

Further, the control 420 controls the sheet turning second means (246, 250, 239, and 249) according to the combination of whether it is necessary to form a color image on only one or both surfaces of the sheet P, and whether it is necessary to form a transparent image on only one or both surfaces of the sheet P. With the employment of this control method, as multiple sheets P of recording medium are discharged from the second fixing device 245, all the sheet P are positioned in the same direction.

Table 1 shows the entirety of the sheet turning processes in the color image forming apparatus 100 and transparent image forming apparatus 200 in the second preferred embodiment of the present invention. The control 420 discharges the sheet P from the color image forming apparatus 100 with the reference to Table 1, whereas the control 520 discharges the sheet P from the transparent image forming apparatus 200 with reference to Table 1 as well.

TABLE 1

| | COLOR IMAGE | | | |
|---|---|---|---|---|
| | ONE SIDE | | BOTH SIDES | |
| CLEAR | 1ST REVERSE | 2ND REVERSE | 1ST REVERSE | 2ND REVERSE |
| NO | REVERSE | NON | NON | NON |
| SIDE 1 | NON | REVERSE | REVERSE | REVERSE |
| SIDE 2 | REVERSE | NON | NON | NON |

TABLE 1-continued

| | COLOR IMAGE | | | |
|---|---|---|---|---|
| | ONE SIDE | | BOTH SIDES | |
| CLEAR | 1ST REVERSE | 2ND REVERSE | 1ST REVERSE | 2ND REVERSE |
| BOTH SIDES | REVERSE | REVERSE | NON | REVERSE |

Referring to Table 1, whether or not it is necessary to turn the sheet P over before discharging the sheet P before discharging the sheet P from the color image forming apparatus 100 and transparent image forming apparatus 200 in each of the various image formation modes, is determined according to the combination of whether a color image is formed on only one or both surfaces of the sheet P, and whether a transparent image is formed on only one or both surfaces of the sheet P.

(1) In the mode in which no transparent image is formed, a color image is formed on one of the two surfaces of the sheet P, and a transparent image is formed on no surfaces of the sheet P. In this case, after the formation of a color image on one (first) of the surfaces of the sheet P, the sheet P is turned upside down, and then, is conveyed to the transparent image forming apparatus 200. Also in this mode, the sheet turning path 239 is controlled so that after the sheet P is discharged from the second fixing device 245, the edge of the sheet P, which was the leading edge when the sheet P came out of the fixing device 245, remains as the leading edge.

(2) In the mode in which a color image is formed on only one surface of the sheet P, and a transparent image is formed on both surfaces of the sheet P, first, a color image is formed on one of the two surfaces of the sheet P, and a transparent image is formed on both surfaces of the sheet P. In this case, after the sheet P is discharged from the color image forming apparatus 100, it is conveyed to the transparent image forming apparatus 200 after being turned upside down.

(3) In the mode in which a color image is formed on one of the two surfaces of the sheet P, and a transparent image is formed on the surface of the sheet P, on which a color image has just been formed, after the sheet P is discharged from the first fixing device 145, it is conveyed to the transparent image forming apparatus 200 without being turned upside down. Also in this mode, after the sheet P is discharged from the second fixing device 245, the sheet turning path 239 is controlled so that the edge of the sheet P, which was the leading edge of the sheet P when the sheet P was discharged from the second fixing device 245, becomes the trailing edge.

(4) In the mode in which a color image is formed on both surfaces of the sheet P, and no transparent image is formed on either surface of the sheet P, after the sheet P is discharged from the first fixing device 145, it is conveyed to the transparent image forming apparatus 200 without being turned upside down.

(5) In the mode in which a toner image is formed on both surfaces of the sheet P, and no transparent image is formed on either surface of the sheet P, the after the sheet P is discharged from the first fixing device 145, it is conveyed to the transparent image forming apparatus 200 without being turned upside down.

(6) In the mode in which a color image is formed on both surfaces of the sheet P, and a transparent image is formed on only one surface of the sheet P, after the sheet P is discharged from the color image forming apparatus 100, it is conveyed to the transparent image forming apparatus 200 after being turned upside down.

(7) In the mode in which a color image is formed on one surface of the sheet P, and a transparent image is formed on only the opposite surface of the sheet P, from the surface on which a color image has just been formed, after the sheet P is discharged from the first fixing device 145, it is conveyed to the transparent image forming apparatus 200 after being turned upside down.

(8) In the mode in which a color image is formed on both surfaces of the sheet P, and a transparent image is formed on only the opposite surface of the sheet P from the first surface on which a color image was formed, after the sheet P is discharged from the first fixing device 145, it is conveyed to the transparent image forming apparatus 200 without being turned upside down.

Embodiment 3

In the third preferred embodiment of the present invention, images were formed using an image formation system which has eight operational modes inclusive of the sheet turning process, and is controlled in the same manner as the manner in which the image forming system in the second embodiment was controlled, and a conventional image formation system, that is, an image forming system which has eight operational modes which do not include the sheet turning process. Then, the images formed by the former are compared in terms of the measured amount of gloss with those formed by the latter.

Table 1 and Table 2 show the amount of gloss of the surface of the sheet P of ordinary paper (81 g/m$^2$) (when surface has image, image is solid image). More specifically, they show which of the two heating means, that is, the fixation roller 45*i* and pressure belt 45*d*, the first and second surfaces (opposite surface) of the sheet P face when the sheet P is conveyed through the fixing devices 145 and 245. The pressure belt 24*d* is higher in target temperature than the fixation roller 45*i*, and therefore, does not increase the image in gloss as mush as the fixation roller 45*i*.

Table 2 shows the results of the measurement in gloss of the images obtained using the conventional control, that is, the control which does not take into consideration the process of turning the sheet P of recording medium around or upside down before discharging the sheet P from the color image forming apparatus 100.

TABLE 2

| COLOR | CLEAR | | ROLLER CONTACTED IN FIXING DEVICE | | | GLOSS * NON-CLEAR | GLOSS DIFFERENCE |
|---|---|---|---|---|---|---|---|
| ONE SIDE | NO | 1 SIDE | FIX | FIX | | *30 | |
| | | 2 SIDE | PRESS | PRESS | | SHEET SURFACE | |
| | SIDE 1 | 1 SIDE | FIX | FIX | | *20 | |
| | | 2 SIDE | PRESS | PRESS | | SHEET SURFACE | |
| | SIDE 2 | 1 SIDE | FIX | FIX | PRESS | *35 | 15 |
| | | 2 SIDE | PRESS | PRESS | FIX | 20 | |

TABLE 2-continued

| COLOR | CLEAR | | ROLLER CONTACTED IN FIXING DEVICE | | | | GLOSS * NON-CLEAR | GLOSS DIFFERENCE |
|---|---|---|---|---|---|---|---|---|
| | BOTH SIDES | 1 SIDE | FIX | FIX | PRESS | | 25 | 5 |
| | | 2 SIDE | PRESS | PRESS | FIX | | 20 | |
| BOTH SIDES | NO | 1 SIDE | FIX | PRESS | PRESS | | *25 | 5 |
| | | 2 SIDE | PRESS | FIX | FIX | | *30 | |
| | SIDE 1 | 1 SIDE | FIX | PRESS | PRESS | FIX | 20 | 15 |
| | | 2 SIDE | PRESS | FIX | FIX | PRESS | *35 | |
| | SIDE 2 | 1 SIDE | FIX | PRESS | PRESS | | *25 | 5 |
| | | 2 SIDE | PRESS | FIX | FIX | | 20 | |
| | BOTH SIDES | 1 SIDE | FIX | PRESS | PRESS | FIX | 20 | 5 |
| | | 2 SIDE | PRESS | FIX | FIX | PRESS | 25 | |

As is evident from Table 2, in the case of the conventional processes, the surface of the sheet P, on which an image is present was in a range of 20-35 in gloss. In this case, even the surface of the sheet P, on which a transparent image was not formed, was no less in gloss than 35, being unnecessarily higher in gloss. Further, there was a difference of 15 in gloss between the first and second surfaces of the sheet P, which made the finished print appear lower in quality.

Table 3 shows the results of the measurement in gloss of the prints obtained by the image formation system in accordance with the present invention while turning the sheet P around or upside down according to the image formation modes of the color image forming apparatus 100 before the sheet P is discharged from the apparatus 100.

TABLE 3

| COLOR | IMPROVEMENT | CLEAR | | ROLLER CONTACTED IN FIXING DEVICE | | | | GLOSS * NON-CLEAR | GLOSS DIFFERENCE |
|---|---|---|---|---|---|---|---|---|---|
| ONE SIDE | G | NO | 1 SIDE | FIX | PRESS | | | *20 | |
| | | | 2 SIDE | PRESS | FIX | | | SHEET SURFACE | |
| | | SIDE 1 | 1 SIDE | FIX | FIX | | | *20 | |
| | | | 2 SIDE | PRESS | PRESS | | | SHEET SURFACE | |
| | G | SIDE 2 | 1 SIDE | FIX | PRESS | | | *20 | 0 |
| | | | 2 SIDE | PRESS | FIX | | | 20 | |
| | G | BOTH SIDES | 1 SIDE | FIX | PRESS | FIX | | 20 | 5 |
| | | | 2 SIDE | PRESS | FIX | PRESS | | 25 | |
| BOTH SIDES | | NO | 1 SIDE | FIX | PRESS | PRESS | | *25 | 5 |
| | | | 2 SIDE | PRESS | FIX | FIX | | *30 | |
| | G | SIDE 1 | 1 SIDE | FIX | PRESS | FIX | | 20 | 0 |
| | | | 2 SIDE | PRESS | FIX | PRESS | | *20 | |
| | | SIDE 2 | 1 SIDE | FIX | PRESS | PRESS | | *25 | 5 |
| | | | 2 SIDE | PRESS | FIX | FIX | | 20 | |
| | | BOTH SIDES | 1 SIDE | FIX | PRESS | PRESS | FIX | 20 | 5 |
| | | | 2 SIDE | PRESS | FIX | FIX | PRESS | 25 | |

As is evident from Table 3, the surface of the sheet P, on which an image was formed, was in a range of 20-30 in gloss regardless of the image formation mode. Further, even the surface of the sheet P, on which a transparent image was not formed, was no more than 25 in gloss, which falls within a tolerable range. Further, the amount of difference in gloss between the first and second surfaces of the sheet P was no more than roughly 5, which made the finished prints appear excellent in image quality.

With the use of the processes such as those described above, it is possible to minimize the total number of times the sheet P of recording medium is conveyed through the fixing device or devices in such a manner that the final image on the sheet P of recording medium faces the fixation roller, whether the final image is a color image with no clear coat (transparent image), or a color image with a clear coat (transparent image). Therefore, it is possible to minimize the unnecessary amount by which the final image is increased in gloss.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 189467/2010 filed Aug. 26, 2010 which is hereby incorporated by reference.

What is claimed is:

1. An image forming system comprising:

a non-transparent image forming apparatus including, a first image forming station for forming a non-transparent toner image and for transferring the non-transparent toner image onto a recording material, first image heating means for heating a surface of the recording material which carries the toner image and which is discharged from said first image forming station, and first re-feeding means for re-feeding the recording material discharged from said first image heating means to said first image forming station with a reversed facing orientation; and a transparent image forming apparatus including, a second image forming station for forming a transparent toner image and for transferring the transparent toner image onto the recording material discharged from said first image heating means, second image heating means for heating a surface of the recording material discharged from said second image forming station, second re-feeding means for re-feeding the recording material from said second image heating means to said second image forming station with a reversed facing orientation, wherein formation of images as a combination of the non-transparent image and the transparent image is capable on both sides of the recording material by controlling said first re-feeding means and said second re-feeding means;

said image forming system further comprising, first reversing means for feeding the recording material discharged from said first image heating means to said second image forming station with a reversed facing orientation, control means for controlling said first reversing means in accordance with a combination of a non-transparent image formation process and a transparent image formation process for both sides of recording material so that a number of heating operations to which outermost layers of final fixed images are subjected to by said first image heating means and by said second image heating means are the same.

2. A system according to claim 1, wherein said first reversing means reverses facing orientation of the recording material while reversing a leading-trailing relation of the recording material, and said system further comprises second reversing means for reversing the recording material discharged from said second image heating means in a facing orientation while reversing a leading-trailing relation, and wherein said control means controls said second reversing means in accordance with a combination of the non-transparent image and the transparent image of the sides of the recording material so as to discharge the recording material to a downstream side with the leading-trailing relation aligned.

3. A system according to claim 2, wherein in a first mode operation the transparent image is formed on a side of the recording material having a formed non-transparent image, and said control means feeds the recording material to said second image forming station while keeping the facing orientation of the recording material discharged from said first image heating means, and in a second mode operation the non-transparent image is formed on one side of recording material and no transparent image is formed on either side, and said control means controls said first reversing means so as to reverse the recording material to be fed to said second image forming station in facing orientation.

4. A system according to claim 3, wherein in a third mode operation the non-transparent image is formed on one surface of the recording material and the transparent image is formed only on the opposite side, and said control means controls said first reversing means so as to reverse the recording material to be fed to said second image forming station in the facing orientation.

5. A system according to claim 3, wherein in a fourth mode operation the non-transparent image is formed on one side of the recording material and the transparent image is formed on each of the sides, and said control means controls said first reversing means so as to reverse the recording material to be fed to said second image forming station in the facing orientation.

6. A system according to claim 3, wherein in a fifth mode the non-transparent image is formed on each of the sides and the transparent image is formed on one side, and said control means controls said first reversing means so as to reverse the recording material to be fed to said second image forming station in the facing orientation.

7. A system according to claim 3, wherein said non-transparent image forming apparatus having said first reversing means and said image forming apparatus having said second reversing means are disconnectably connected with each other.

8. A system according to claim 7, wherein in the first mode operation, said control means controls said second reversing means so as to reverse a leading-trailing relation of the recording material discharged from said second image heating means, and in a mode in which no transparent image is formed, said control means controls said second reversing means while keeping the leading-trailing relation of the images on the recording material discharged from said second image heating means.

* * * * *